United States Patent [19]

Eaton

[11] 4,051,345

[45] Sept. 27, 1977

[54] ELECTRODE TIP FOR HIGH VOLTAGE ELECTRODES OF THE TYPE UTILIZED IN HIGH VOLTAGE BOILERS

[76] Inventor: Milton Eaton, 363 Ninth Street, Shawinigan, Quebec, Canada

[21] Appl. No.: 617,152

[22] Filed: Sept. 26, 1975

[51] Int. Cl.[2] ..... H05B 3/60; F22B 1/30; H01C 10/02

[52] U.S. Cl. ..... 219/288; 219/275; 219/285; 219/294; 338/86

[58] Field of Search ..... 219/284–295, 219/271–276; 338/80–86

[56] References Cited

U.S. PATENT DOCUMENTS

| | | | |
|---|---|---|---|
| 2,088,932 | 8/1937 | Stalhane | 219/288 X |
| 2,676,240 | 4/1954 | Eaton | 219/285 |
| 3,138,696 | 6/1964 | Eaton | 219/288 X |
| 3,496,334 | 2/1970 | Williams | 219/288 |

*Primary Examiner*—A. Bartis
*Attorney, Agent, or Firm*—Diller, Brown, Ramik & Wight

[57] ABSTRACT

A jet-protected electrode tip for high voltage electrode boilers from which boiler water is taken, mixed with the boiler feedwater or other water of lower temperature taken from an outside source and pumped through circuits terminated by a nozzle located below and pointing upward towards the tip of each electrode. A boiler having this distinguishing feature is commonly referred to as a jet-flow electrode boiler. The water is discharged through the nozzle and ejected as a jet stream having sufficient velocity to prevent oscillation thereof about the electrode tip. The improvement comprises passing a portion of the jet stream as a continuous stream through an inlet passage leading to a central chamber in the electrode tip, thereby maintaining electrical contact between the jet and the electrode tip. The inlet passage is disposed on the central longitudinal axis of the electrode. At least two return passages extend from the central chamber to the outer wall of the electrode tip body in a downward direction relative to the longitudinal axis of the electrode whereby water entering the central chamber of the electrode tip through the inlet passage in an upward direction, is returned out of the central chamber of the electrode tip through the return passages to the space below the electrode tip where the cooling effect of the returned water limits the steam generation in the space below the electrode tip. The electrode tip construction provides a number of advantages including the use of boiler water of higher conductivity resulting in great operating efficiency.

9 Claims, 2 Drawing Figures

ELECTRODE TIP FOR HIGH VOLTAGE ELECTRODES OF THE TYPE UTILIZED IN HIGH VOLTAGE BOILERS

BACKGROUND OF THE INVENTION

A. Field of the Invention

The present invention relates to high voltage electrode boilers commonly referred to as a jet-flow electrode boiler, from which water is taken, mixed with water of lower temperature from an outside source, and the mixture pumped through a nozzle located below and pointing upward towards the tip of each electrode and more particularly to an improved electrode tip therefor.

B. Description of Prior Art

For background information on such boilers and electrodes, reference is made to Canadian Pat. No. 550,072, issued Dec. 10, 1957 and entitled "Electric Steam Generator" and also to Canadian Pat. No. 626,610, issued Aug. 29, 1961 and entitled "Tip Shielded Electrode for Electric Boilers".

SUMMARY OF THE INVENTION

In such known type, high voltage electric boilers, cylindrical electrodes are located in respective steam generating compartments to produce steam. It was found that at low operating water levels on an electrode the jet of water discharged from the nozzle located below it made imperfect electrical contact with the electrode tip, thus causing a flashing or arcing condition that resulted in flashovers to the neutral. It was also found that at any boiler load or water level on the electrodes cooling effect of the jetted water is required to limit the rate of steam generation below the electrode tips, which would otherwise result in a flashing or arcing condition causing accelerated electrode erosion unless the boiler water conductivity was maintained at a relatively low value. The electrodes are normally cylindrical and are made with tips of hemispherical configuration.

It may be shown by calculation that the concentration of energy at hemispherical electrode tips is about three times greater than on the vertical sides of the cylindrical electrodes. Steam generated is also freely released from the vertical sides of the electrodes whereas it is held below the electrode tips over which it tends to form steam envelopes, resulting in an arcing condition and accelerated electrode erosion. For any operating high voltage, this condition imposes a limitation on the permissible boiler water conductivity which is increased by the cooling and steam dispersal action of the jets.

In an early boiler design an attempt was made to use jets of relatively large diameter and low velocity, the object being to obtain a uniform decrease in electrode current as the water level falls below the electrode tips. With jets of relatively small diameter the electrode current falls off sharply as the water level falls below the tips of the electrodes, thus creating a portion of the range of the water level in which operation tends to be unstable. It was found in practice, however, that jets of relatively large diameter and low velocity oscillated around the hemispherical electrode tips with an arcing condition in their wake and that in order to prevent this condition the jets had to be made relatively small and with relatively high velocity. With this equipment, hemispherically tipped electrodes proved to operate satisfactorily for boiler loads down to about 15% of full load. At light loads and low water levels the water jets bounced off the electrode tips, thus obtaining imperfect electrical contact and an arcing condition that developed into a flashover to the neutral and consequent circuit breaker operation. This condition was corrected with the use of tip shielded electrodes, as disclosed in Canadian Pat. No. 550,072. As shown in that patent, the electrodes have tip shields each provided with a central passage through which sufficient jetted water flows to maintain the electric circuit. The passage dimensions are made small enough to restrict the flow sufficiently for about 50% of the jetted water stream to be spilled over the electrode tip where its cooling and steam dispersal action tends to prevent the formation of a steam envelope and consequent arcing condition.

It is a feature of the present invention to provide improved means for performing the function of electrode tip shields, whereby all the cooling and dispersal action of the jetted water is used effectively, thereby obtaining more efficient boiler operation with higher boiler water conductivity.

According to the above features, from a broad aspect, the present invention provides an electrode tip for electrodes of the type utilized in high voltage electrode boilers from which water is taken, mixed with water of lower temperature from an outside source and the mixture pumped through a nozzle located below and pointed upward towards the tip of each electrode. The electrode tip comprises a body having an outer wall for contact with water in a steam generating chamber. An inlet passage extends into the body of the electrode tip from the outer wall to a central chamber in the electrode tip and disposed on the central longitudinal axis of the electrode. At least two return passages extend from the central chamber to the outer wall of the body in a downward direction relative to the longitudinal axis of the electrode whereby water entering the central chamber of the electrode tip through the inlet passage in an upward direction is returned out of the central chamber of the electrode tip through the return passages to the space below the electrode tip where the cooling effect of the returned water limits the steam generation in the space below the electrode tip.

From a further broad aspect, the present invention provides a high voltage electrode boiler of the jet-flow type from which boiler water is taken, mixed with boiler feedwater and pumped through circuits terminated with a nozzle located below and axially aligned with an electrode in the boiler. The electrode has a tip body with an outer wall. The pumped water is discharged as a jet stream and has sufficient velocity to prevent oscillation of the jet stream about the tip outer wall. The improvement comprises an inlet passage extending into the tip body from the outer wall and disposed on the central longitudinal axis of the electrode. At least two return passages extend into the body from the outer wall and disposed angularly to the said central longitudinal axis. The inlet and return passages are interconnected within the body, whereby water from the jet stream entering the inlet passage in an upward direction through the body will be returned out of the body in a downward direction through the return passages.

PREFERRED DESCRIPTION OF DRAWINGS

A preferred embodiment of the present invention will now be described with reference to the drawings in which:

FIG. 1 is a sectional diagrammatic view of a high voltage electric boiler of the prior art; and FIG. 2 is a sectional fragmented view illustrating a portion of a steam generating compartment with a high voltage electrode having the electrode tip of the present invention.

DESCRIPTION OF PREFERRED EMBODIMENTS

Figure 1:
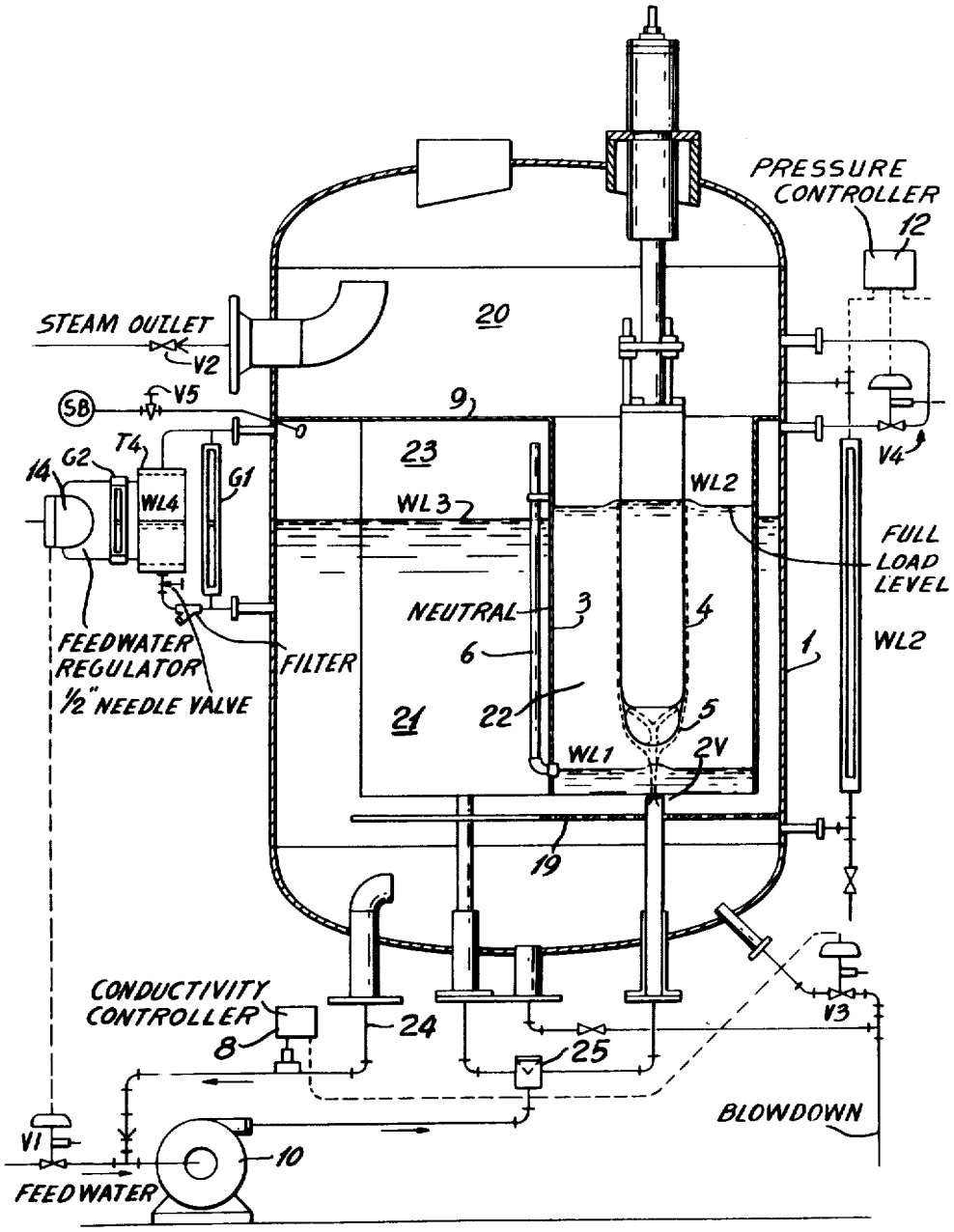
Fig. 1 PRIOR ART

Referring to FIG. 1, there is shown a high voltage electrode boiler of the prior art and generally referred to as a jet-flow electrode boiler. A brief description thereof, follows to better understand the present invention which will be described with reference to FIG. 2. The boiler comprises a shell 1, which is divided by diaphragm plate 9 into an upper steam release compartment 20 and a lower section 21. A cylindrical neutral wall 3 surrounds each electrode 4 and opens into the diaphragm plate 9. The neutrals 3 enclose the steam generating compartment 22. The space outside the neutrals and below diaphragm plate 9 is the control compartment 23. Steam is generated by the $I^2R$ energy dissipated in the water surrounding each electrode 4.

The electrode current I is controlled by the water level WL2 about the electrode 4, which varies in response to the boiler steam pressure controller 12 with control valve V4. Valve V5, is adjusted for a bleed off of steam (SB) from the top of the control compartment 23 at the rate of about 1% of boiler full load. When the boiler steam pressure rises above the set point of controller 12, valve V4 decreases the rate at which steam enters the control compartment 23, thereby causing the water level WL2 about the electrode 4 to fall and water level WL3 in the control compartment to rise. This action is accelerated by condensation of steam in the control compartment 23 caused by water below steam temperature coming into contact with it. Similarly, if the controlled boiler steam pressure falls below the set point of controller 12, valve V4 increases its opening and water level WL2 will rise, thereby increasing the boiler power input. The feedwater regulator 14 is responsive to the controlled water level WL3 in the control compartment 23.

Water level WL1 illustrates the low limit of water level WL2. Perforated plate 19 prevents electrode current reaching the bottom of the boiler shell 1, where it would cause corrosion thereof.

Water taken from the boiler through pipe 24 by pump 10 is mixed with the boiler feedwater or other water of lower temperature taken from an outside source and pumped through circuits including distributor 25 and terminating with a nozzle 2 pointing upwards towards the tip 5 of each electrode 4. The water is discharged from the nozzle 2, as a jet stream having sufficient velocity to prevent oscillation of the water about the electrode tip 5. The function of the jet stream for high voltage boiler operation is (1) to maintain the electric circuit as the water level WL2 falls below the electrode tips, and (2) to absorb energy at the electrode tips 5 by the amount required to heat the boiler feedwater to steam temperature.

Figure 2:
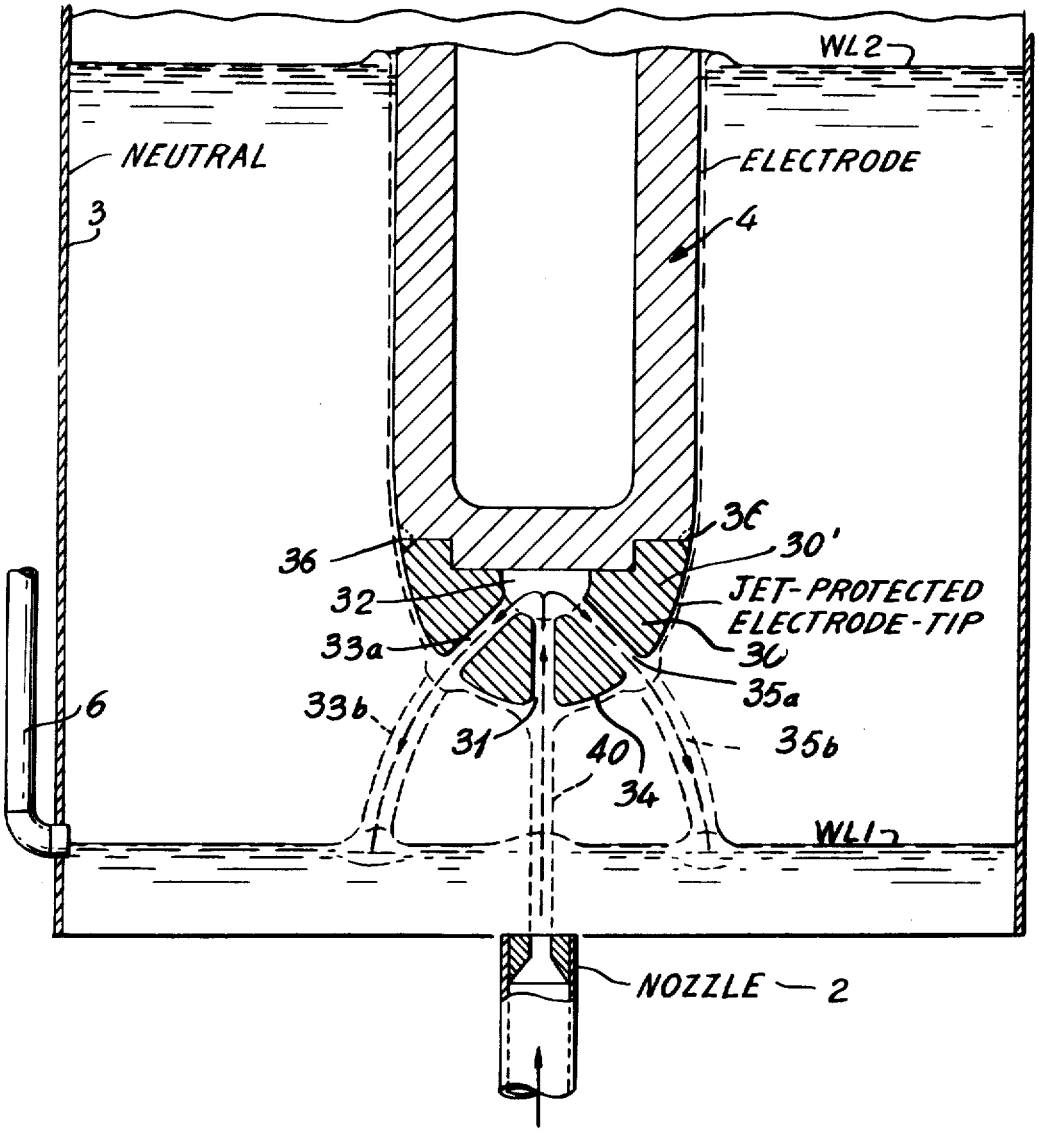

As shown schematically in FIG. 2, the jet-protected electrode tip 30 comprises a body 30' having an outer wall or surface 34 which is provided with a central water inlet passage 31 through which a portion of the water jet stream 40, discharged from nozzle 2, passes to chamber 32 from which it is discharged through return passages 33*a* and 35*a* as water streams 33*b* and 35*b*. The size of the water passage 31 is such that about 25% of the jetted water stream 40 is spilled over the outer surface 34 of the electrode tip 30 and the size of the return flow passages 33*a* and 35*a* is made large enough for the streams of water 33*b* and 35*b* to be discharged from the electrode tip at relatively low velocity.

When the operating level WL2 is above the electrode tip 30, streams 33*b* and 35*b* are held and distributed in the upward movement of water, directly under each electrode tip, induced by the jet stream 40 and the upward release of steam from the electrode 4 which is much greater from the water near the electrodes than it is as the neutral wall 3 is approached. As the water level, WL2, on light load, falls below the electrode tip 30 and approaches water level WL1, the streams of water 33*b* and 35*b* continue to make contact with the descending water level WL2, thereby paralleling jet stream 40 as part of the electric circuit.

Since the jet-protected electrode tip 30 is still the most vulnerable part of the electrode 4, as shown schematically in FIG. 2, it is made conveniently replaceable. As shown in FIG. 2, it may be held in place by spot welds 36 or by other conventional means known to persons skilled in the art.

As shown schematically in FIG. 2, only two return flow water passages 33*a* and 35*a* are provided, whereas four or more, depending on the size of the electrode tip, symmetrically spaced, are preferred. Also, the proportion of the jetted water entering water passage 31 may be made more or less than 25%. Further, the distance between electrode tip 30, and nozzle 2 varies with the operating voltage for which the boiler is designed.

Although the return water passages, as shown in FIG. 2, are inclined at an angle of 45° with the vertical centre line of the electrode, a lesser angle of inclination may be provided.

For a sustained cooling effect in the jetted water, when it is provided by the feedwater only, proportional feedwater regulation with an appreciable minimum rate of flow is required.

The advantages of the present invention can be briefly summarized as follows:

1. The portion of the jetted water passing through the water passages in an electrode tip maintains the electric circuit regardless of jet bouncing action which occurs as the water level in the steam generating compartment approaches or falls below the electrode tip;

2. Substantially all the cooling effect of the cooling water content of the jetted water stream is used in the water below the electrode tip, thus reducing to a minimum the amount of steam generated in this space;

3. The conductivity of the boiler water and the energy concentration at the surface of an electrode tip may be increased about 50% as compared with the permissible energy concentration when about 50% of the jetted water stream is deflected from the electrode tip;

4. A uniform rate of decrease in electrode current is maintained as the operating water level falls below the electrode tip;

5. With higher boiler water conductivity the amount of blowdown required for conductivity control is decreased and the boiler operating efficiency is proportionally increased; and 6. The increase in permissible energy concentration reduces the required length of an electrode and the overall height of a boiler, which is of particular advantage in locations where head room is limited.

I claim:

1. An electrode tip for electrodes of the type utilized in high voltage electrode boilers from which water is taken, mixed with water of lower temperature from an outside source and the mixture pumped through a nozzle located below and pointed upward towards the tip of each electrode, said electrode tip comprising a body having an outer wall for contact with water in a steam generating chamber, an inlet passage extending into said body from said outer wall to a central chamber in said electrode tip and disposed on the central longitudinal axis of said electrode, at least two return passages extending from said central chamber to said outer wall of said body in a downward direction relative to said longitudinal axis of said electrode whereby water entering said central chamber of said electrode tip through said inlet passage in an upward direction is returned out of said central chamber of said electrode tip through said return passages to the space below the electrode tip where the cooling effect of the returned water limits the steam generation in said space below the electrode tip.

2. An electrode tip as claimed in claim 1 wherein said body is provided with means for securement to a lower end of an elongated electrode housing.

3. An electrode tip as claimed in claim 1 wherein said return passages are of sufficient size and number to permit the discharge of water entering said chamber through said inlet passage at a velocity lower than said water entering said inlet passage.

4. An electrode tip as claimed in claim 3 wherein a plurality of said return passages are provided in said body, said return passages being equidistantly spaced in a concentric ring about said inlet passage and extending from said outer wall to said internal chamber.

5. An electrode tip as claimed in claim 1 wherein said return passages are inclined downwardly at an angle of approximately 45° with the said inlet passage.

6. An electrode tip as claimed in claim 1 wherein said inlet passage has a diameter equal to that of the nozzle from which the water jet stream is directed thereat.

7. An electrode tip as claimed in claim 1 wherein said return passages are disposed at a diverging angle relative to said longitudinal direction of said longitudinal axis of said electrode.

8. In a high voltage electrode boiler from which boiler water is taken, mixed with cooling water from an outside source and pumped through circuits terminated with a nozzle located below and axially aligned with an electrode in said boiler, said electrode having a tip body with an outer wall, said pumped water being discharged as a jet stream and having sufficient velocity to prevent oscillation of said jet stream about said tip outer wall, the improvement comprising an inlet passage extending into said body from said outer wall to a central chamber in said electrode tip and disposed on the central longitudinal axis of said electrode, at least two return passages extending from said central chamber to said outer wall of said body in a downward direction relative to said longitudinal axis of said electrode whereby water from said jet stream entering said central chamber of said electrode tip through said inlet passage in an upward direction is returned out of said central chamber of said electrode tip through said return passages to the space below the electrode tip where the cooling effect of the returned water limits the steam generation in said space below the electrode tip.

9. In a high voltage electrode boiler as claimed in claim 8 wherein a plurality of said return passages are provided in said body and equidistantly spaced in a concentric ring about said inlet passage, said return passages being of sufficient size and number to permit the discharge of water entering said chamber through said inlet passage at a velocity lower than the velocity of said water jet stream entering said inlet passage.

* * * * *